US005340087A

United States Patent [19]

Turner

[11] Patent Number: 5,340,087

[45] Date of Patent: Aug. 23, 1994

[54] BALUSTRADES

[75] Inventor: Jack Turner, Rochdale, England

[73] Assignee: The Northern Joinery Limited, Rochdale, United Kingdom

[21] Appl. No.: 819,787

[22] Filed: Jan. 13, 1992

[30] Foreign Application Priority Data

Jan. 12, 1991 [GB] United Kingdom ..... 9100724
Jun. 26, 1991 [GB] United Kingdom ..... 9113785

[51] Int. Cl.[5] ..... E04H 17/14

[52] U.S. Cl. ..... 256/67; 256/65; 256/59; 403/79

[58] Field of Search ..... 256/67, 65, 59, 22, 256/21, 60, 66, 19; 403/79, 67, 70, 120, 71, 66, 68, 166; 16/383-384, 366, 368, 225, 226; 52/183, 184

[56] References Cited

U.S. PATENT DOCUMENTS

| | | | |
|---|---|---|---|
| 2,767,959 | 10/1956 | Schott | 256/19 |
| 2,855,227 | 10/1958 | Bottom | 403/119 |
| 4,125,249 | 11/1978 | Zen | 256/67 |
| 4,344,604 | 8/1982 | Basey | 256/65 |
| 4,352,485 | 10/1982 | Basey | 256/22 X |
| 4,421,302 | 12/1983 | Grimm et al. | 256/59 X |
| 4,509,881 | 4/1985 | Welch | 256/65 X |
| 4,533,121 | 8/1985 | Basey | 256/59 X |
| 4,886,245 | 12/1989 | Manzo | 256/67 |
| 4,928,930 | 5/1990 | Chung | 256/67 |
| 5,056,283 | 10/1991 | Sapinski | 256/65 X |

FOREIGN PATENT DOCUMENTS

| | | | |
|---|---|---|---|
| 0206265 | 9/1991 | Japan | 256/59 |
| 2192209 | 1/1988 | United Kingdom | 256/59 |

*Primary Examiner*—Randolph A. Reese
*Assistant Examiner*—Harry C. Kim
*Attorney, Agent, or Firm*—Salter & Michaelson

[57] ABSTRACT

A balustrade is proposed wherein a hinge device (66) connects each baluster (56) to the rail (55) in such manner as to permit limited pivotal and translational movement therebetween. The hinge device (66) comprises a flat spring of generally J-shape the elongate body (67) of the spring being secured to the rail and the curved end (68) of the spring being secured to the baluster. An inflexible plate (70) overlies the body (67) to restrain the same against movement. Opening of the curved end (68) permits relative pivotal and translational motion between the baluster (56) and rail (55). The arrangement offers advantages in collapse of the balustrade for transportation purposes and also permits of adjustment of the angle between the rail and balusters to accommodate facture and other tolerances.

13 Claims, 5 Drawing Sheets

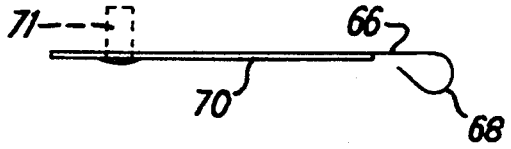
FIG. 15
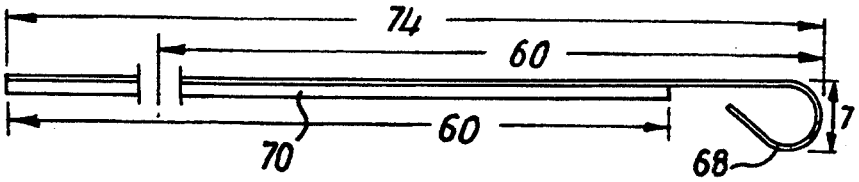
FIG. 16
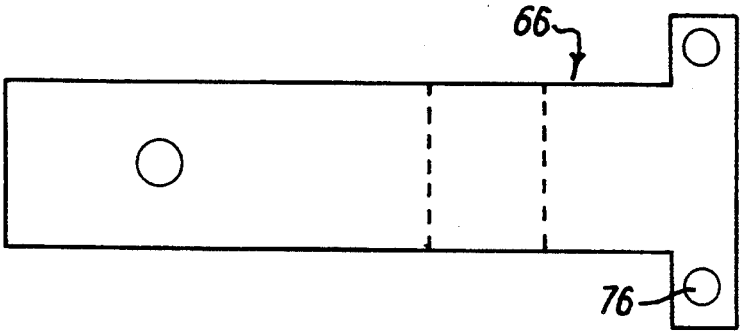
FIG. 17
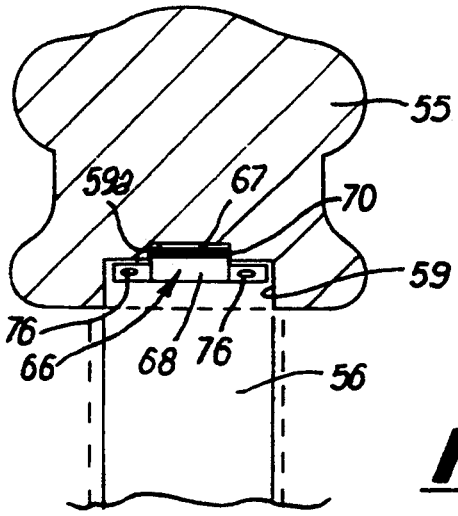
FIG. 18
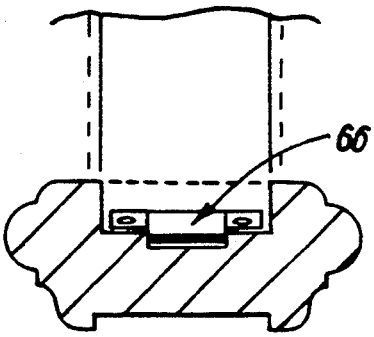

BALUSTRADES

This invention relates to a balustrade, particularly but, not exclusively, for domestic use.

In European Patent No. 246057 there is described a balustrade which includes hand and base rails interconnected by a plurality of balusters. The balusters are pivotally connected to the rails and this offers very significant advantages in the manufacture, transportation and installation of such balustrades. For example, it is possible for the entire balustrade to be manufactured under factory conditions, leading to higher quality and less possibility of damage due to poor site conditions and perhaps inferior labour.

Further, because of its pivotable nature the entire balustrade can be collapsed to a position wherein the two rails are close together and the balusters are disposed nearly parallel thereto. This provides a very compact package enabling storage, transportation and packaging costs to be reduced.

There is the further advantage (described in the specification) that the balustrade can be arranged to fit stairs of slightly varying height and pitch simply by varying the inclination of the rails, whilst always maintaining the balusters vertical. By leaving slightly extra material at the ends of the two rails the only operation needed on site, once the newal posts have been positioned, is the transverse cutting of the two rails to fit the post. This is an operation which can be carried out accurately on site.

The aforementioned patent also describes how the invention is applicable principally to balustrades made out of wood or comparable materials such as moulded plastics material or composite materials which do not have thin section strength as do metal balustrades. There is much prior art (for example exemplified by U.S. Pat. No. 3174727 to Burt) which describes a pivotal connection between a rail and a baluster in a metal balustrade. Because metal is inherently much stronger than wood, the provision of a pivotal connection between metal balusters and metal rails is very easy, particularly if the metal rail is a hollow section. However, a comparison of the problem of machining wood to such tolerances and the necessary thicknesses and strength which would be required make it quite clear that the methods and constructions of Burt and the like are quite unsuitable for use in relation to wooden balustrades.

There is the further disadvantage in the construction described in Burt and, indeed, almost all the metal constructions and many of the old wooden constructions, in that, although the pivoting mechanism can very often be effectively shielded from view by being disposed wholly or partly in the underside of the handrail, the pivot mechanism on the lower rail is exposed. This can be unsightly and is undesirable in a domestic environment. A further disadvantage is that the lower rail very often has to be provided with cavities in its upper surface to accommodate either fastenings or the lower ends of the balusters. As such cavities are upwardly open, they tend to collect finishing material such as varnish or waxes. In use they become reservoirs for dirt and dust and can become most unattractive.

The invention described in the aforementioned U.S. Pat. No. 246057 did avoid this problem, but the connection between the balusters and the rails in that earlier patent did have certain disadvantages.

FIG. 1 is a schematic side elevation of a balustrade 10 on a stair 11. The balustrade 10 has a hand rail 12 and base rail 13 pivotally interconnected by balusters. To the left of FIG. 1 are shown balusters 14 pivoted by the means described in U.S. Pat. No. 246057. It will be seen that the end of each baluster is part cylindrical and effectively makes only line contact with the rails 12 and 13. Whilst the interconnecting devices which allow such pivoting are strong and effective, the apparent point contact which is visible at 15 in FIG. 1 is found in many cases to be aesthetically unattractive. A balustrade which has such apparent point contact appears, to the purchaser, to be more flimsy or fragile than a conventional balustrade wherein an impression of extra strength is given by the fact that the ends of the balusters are (or appear to be) fully housed within the rails.

It is an object of the present invention, therefore, to provide a balustrade which is a further improvement over and above the balustrade of the aforementioned patent.

The invention provides a balustrade which includes a hand rail and a base rail interconnected by a plurality of parallel balusters, each end of each baluster being pivotally attached to its respective rail by a pivot arrangement which includes a socket in the rail adapted closely to surround and receive an end portion of the baluster and a hinge device connecting the baluster end to the rail and constructed and arranged to allow first relative pivotal movement between the baluster and the rail about an axis extending transversely of the rail and baluster and a second translational motion of said end portion of the baluster into and out of said socket.

The invention provides, as a further feature, a baluster/rail connecting hinge device including a first part adapted to be connected to the rail and a second part adapted to be connected to the baluster, said two parts being interconnected in a manner to permit relative pivoting of the two parts and translational movement of one part relative to the other in a direction at right angles to the pivot axis.

Preferably each part is adapted to be essentially a push-fit in its component.

In one embodiment the translational movement can be provided by one of the parts having two members, a first member which is connected to its relevant component and a second member which is connected to the other component and which is telescopically movable relative to the other member. Desirably said telescopic motion is spring loaded in a manner tending to draw the rail and baluster together. To facilitate assembly it is desirable that the part which has two members is connected to the rail. In particular, it is desirable in this case for the rail to be made of two components, the telescopic part of the hinge member being fastened to a lower functional part of the rail which is, in turn, covered by a higher decorative portion to constitute a hand rail.

On the base rail the part of the device having two members can be simply attached to a plain rail as the projection of the said part beneath the base rail will not be visible in use. In the event that the method is used in relation to a balustrade in which the underside of the base rail can be seen in use (for example in an open-plan building) the ends of those parts visible beneath the lower rail can be covered with a cover strip extending the full length of the rail.

As an alternative, the translational motion between the two parts can be provided by the two parts being connected by a bridge, the bridge functioning to space the two parts and being pivotally connected to each. In this case each part can be a simple plug fit into its respective component.

The socket in the appropriate surface of the rail can be such as to suit the baluster. Normally the top and bottom ends of the baluster (even if turned) will be left rectangular. In the past this has been done to improve connection between the baluster and the rail and therefore has become aesthetically accepted. In this case the sockets will be rectangular. However, the invention works equally well with non-rectangular balusters, for example circular balusters which could be accommodated within circular sockets.

For accommodation in the socket the end of each baluster will be provided with an angled face. The part of the baluster which is nearest the acute angle between the face and the length of the baluster will have to be chamfered so as to fit snugly within the socket. In the case of a non-rectangular baluster such chamfering will need to be progressive around the upper side of the baluster.

In the second embodiment, each part of the hinged device can comprise a pair of headed pegs, the heads being connected by a pin. The bridge can comprise a strip of spring steel having a hook at each end rendering the bridge generally of an S-shape. Each hook can be a snap-fit on the respective pin. Thus, after driving the parts into the respective components of each pivot assembly, the two parts can be connected simply by hooking the bridge respectively over the two pins. This solves any problem in driving the members whilst the rail and balustrade are closely interconnected.

In a further arrangement the pivot arrangement between each balluster and the rail is in the form of a spring which is secured to the rail and to the end of the balluster, the spring being J-shaped, a longer body of the spring being secured to the rail and the curve of the spring having an end secured to the balluster.

The invention will be described further, by way of example, with reference to the accompanying drawings wherein:

FIG. 15 illustrates the pivot arrangement and the spring;

FIG. 16 is a side elevation of the spring;

FIG. 17 is a front elevation of the spring; and

FIG. 18 is a vertical cross-section through the baluster of FIG. 13.

Figure 1:
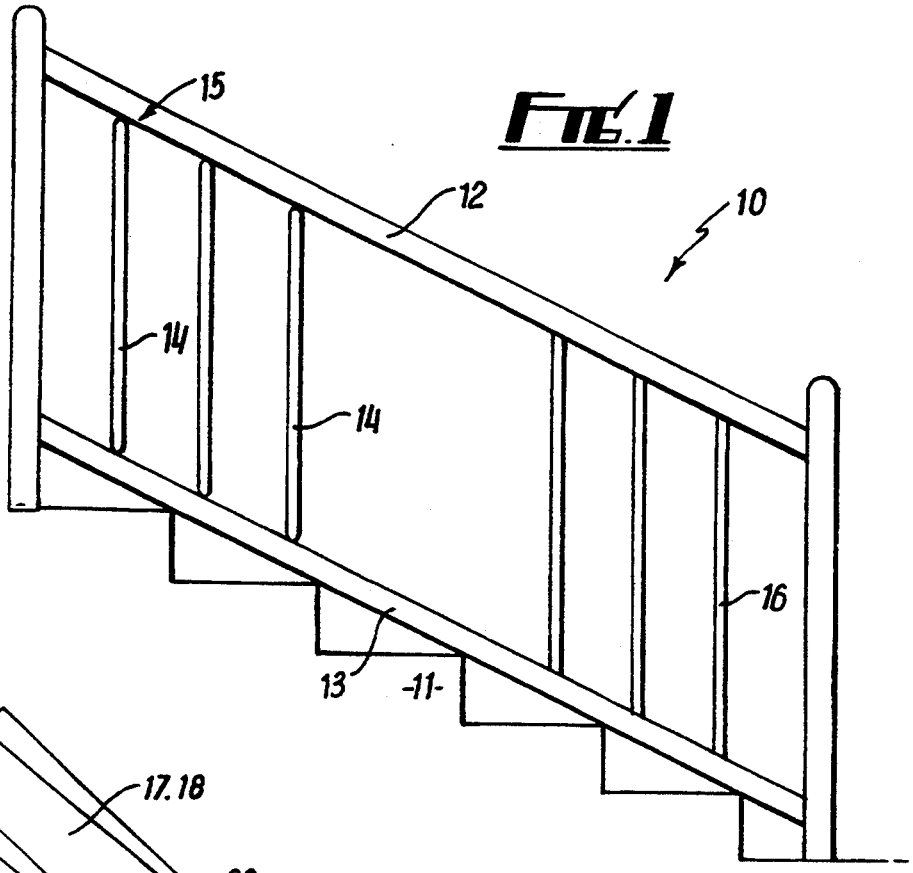
FIG. 1 is a schematic side elevation showing a composite baluster, the left-hand part illustrating a known baluster and the right-hand part illustrating either a conventional non-adjustable fixed baluster or a baluster in accordance with the present invention.

Referring now to FIGS. 2 to 6, a preferred balustrade of the invention has a hand rail 17, a base rail 18 and a plurality of interconnecting balusters 16. Each baluster 16 is connected to its respective rail 17,18 by means of a pivot arrangement indicated at 19 in FIG. 2. The rail 17 only is shown and the construction described relates to connection to the handrail 17. However, an inverse condition exists at the base rail 18. At the pivot arrangement the baluster face of the rail is provided with a rectangular socket 20. An end portion of the baluster 16 is accommodated within the socket 20 in the operative position shown in FIG. 2. In order to be accommodated within the socket 20 the baluster 16 is formed with an inclined face 21. At the upper end of inclinded face 21 (considered in relation to the staircase) the baluster 16 is arcuately chamfered to form a face 22 which is part cylindrical. Adjacent the lower end the baluster 16 is pivotally connected to the rail by means of a hinge assembly 23. The hinge assembly 23 includes a first part 24 which connect with the baluster 16 and a second part 25 which connects with the rail. The first part 24 includes a saw tooth plug 26 which is accommodated in a slightly undersized hole formed in the baluster 16. At its outer end the plug 26 has a body 27 through which passes a pivot pin 28. The pivot pin 28 also passes through a two part body 29 of the second part 25 of the hinge assembly. Each body part 29 is connected to a respective first piston member 30 of the part 25. Each piston member 30 is accommodated within a cylinder part 31. Each cylinder part 31 is a push fit in an aperture in the rail 17 (see FIG. 2) and is restrained from passing through the rail by an annular flange 32. Internally each cylinder part 31 has an annular shoulder 33. A screw 34 passes through the shoulder 33 and engages with a respective piston part 30. A compression spring 35 is disposed between the head of the screw 34 and the shoulder 33 so that the body 29 of the assembly 23 is resiliently urged towards the rail 17.

Figure 2:
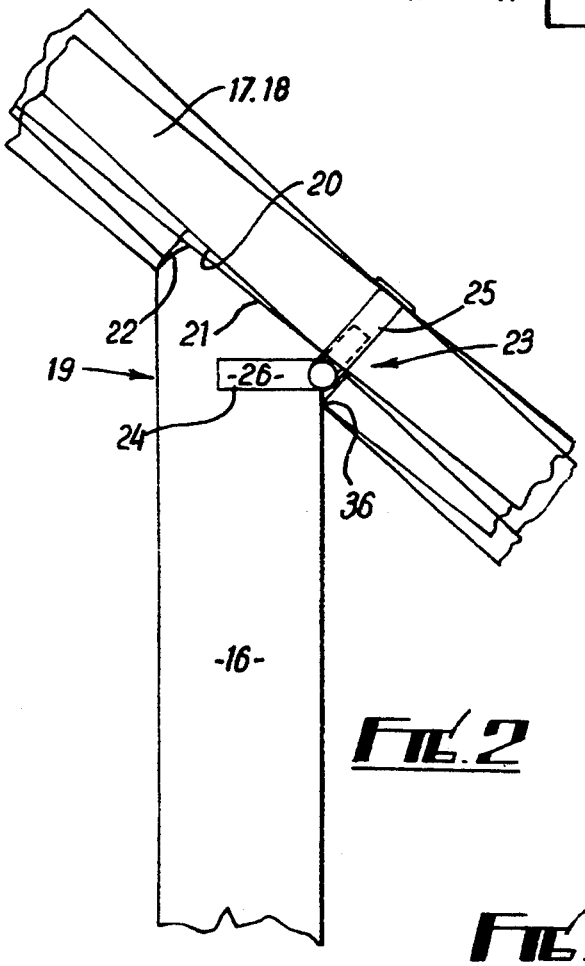
FIG. 2 is a side elevation illustrating a first preferred pivot arrangement in a baluster of the invention.

In use, folding of the balustrade for storage and transportation purposes after manufacture in a factory can be effected by moving the ends of the baluster 16 out of their recesses 20 and then pivoting them about the axes of the pins 28 so that the two rails are fairly close together and the balusters lie almost parallel to the rails. This is possible because the axle 28 can be moved relative to the rail 17,18 to allow pivoting of the balusters without interference between the sockets 20 and the upper ends of the balusters. This means that the balusters 16 can be folded parallel to each other and very close together and almost parallel to rails 17, 18 to create a very small package for transportation and storage. As will be later described the second embodiment also has a comparable movable pivot axis which enables such moving and pivoting to be carried out Upon assembly the end portions of the balusters will be accommodated snugly and almost wholly within the sockets 20. The necessary slight adjustment which is usually necessary upon installation (typically the angle between the rails and the balusters only needs to vary between 38 and 42 degrees) can be accommodated by relative pivoting of the rails and balusters about the axis of the pins 28. This pivoting is illustrated in FIG. 2. It will be appreciated that due to the two degrees of freedom the downward face of the baluster actually pivots about the edge 36, whilst the face 22 (which is cylindrical about the axis of pin 28) slides relative to the top edge of the recess 20.

As is shown in FIG. 2 there is no visible cavity which, in the case of the lower rail would form a catchment for dirt, dust, varnish , lacquer or the like which could become unsightly. At both ends the balusters appear to be solidly connected to the rails, and the pivotal nature of the connection cannot be seen. This greatly enhances the aesthetic appeal of the balustrade.

Figure 6:
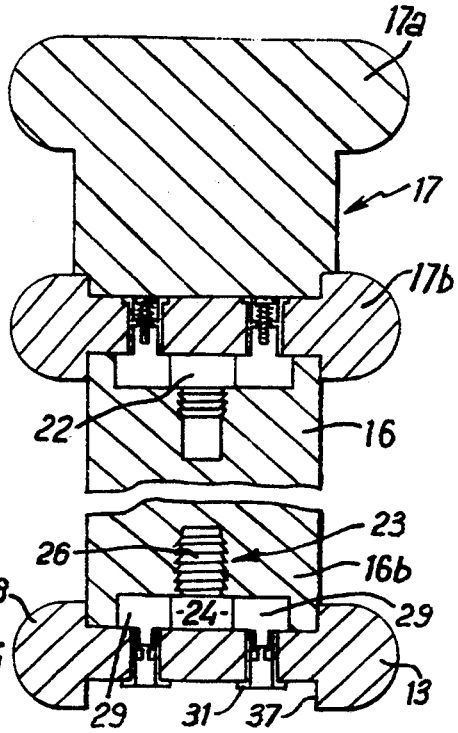
FIG. 6 is an enlarged cross-section view illustrating the arrangement of FIG. 2 in position.
Figure 3:
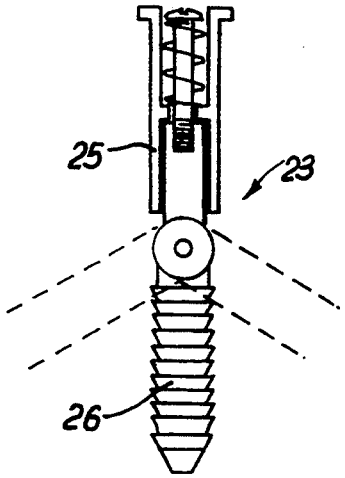
FIG. 3 shows a hinge assembly of the arrangement of FIG. 2 in side elevations.
Figure 4:
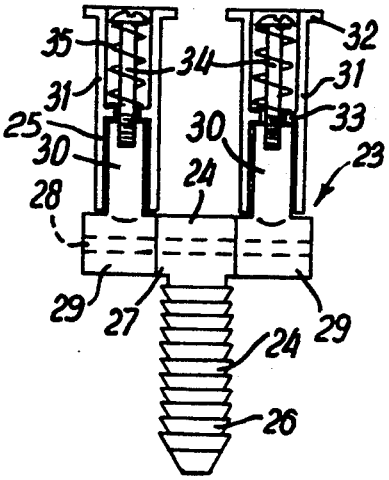
FIG. 4 shows the assembly in front view.
Figure 5:
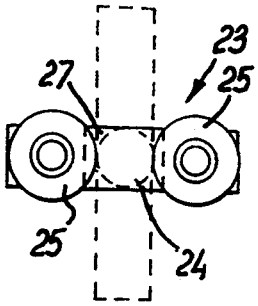
FIG. 5 shows the assembly in plan view.
Figure 7:
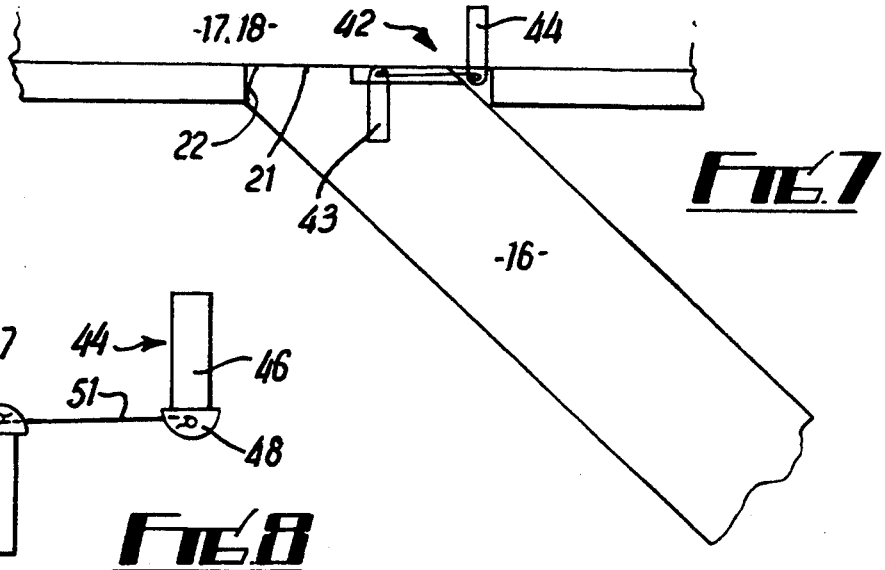
FIG. 7 shows a second pivot arrangement of a second embodiment of a baluster of the invention.
Figure 8:
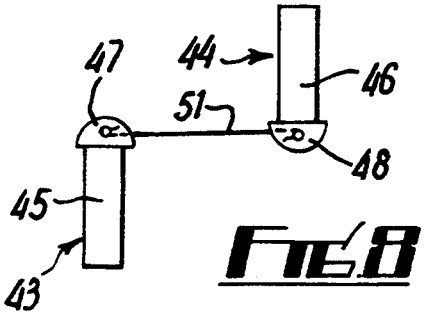
FIG. 8 shows a hinge assembly of the arrangement of FIG. 7 in side view.
Figure 9:
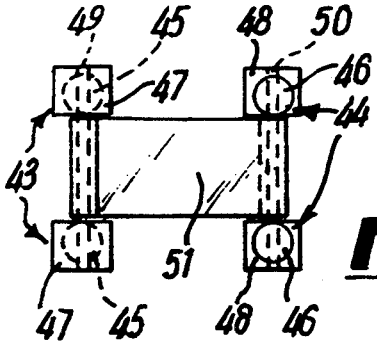
FIG. 9 shows the hinge assembly in plan view.
Figure 10:
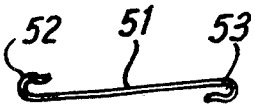
FIG. 10 is a side view of a bridge of the assembly of FIGS. 8 and 9.

As will be appreciated, the second part of the hinge assemblies 23 have to be assembled from a side of the rail remote from the baluster. How this is achieved is shown in FIG. 6. In the case of the lower end 16*b* of the baluster, the base rail 13 has a lower channel 37 in which the ends of the cylinder member 31 are concealed. As the channel 37 is directed downwards, the parts are not visible in use. However, in the case of a balustrade installed in a location where it might easily be seen frequently from below, the channel 37 could be filled with a cover strip.

At the upper end, it would, of course, be unacceptable for the parts 25 to be visible. For this reason the hand rail 17 is made in two parts. An upper portion 17*a* which could be described as a decorative portion and a lower portion 17*b* which could be described as a functional portion. The respective cylinder members of the second parts 25 are first secured to the functional portion 17*b* as described earlier. Thereafter, the decorative portions 17*a* is mated with the portion 17*b*. It is very convenient if the portion 17*b* and the lower rail 13 are made identical. This allows a single machining tool configuration to be used to make for both parts. Connection between the parts 17*a* and 17*b* can be by means of an adhesive, and/or by means of discrete fasteners passing upwardly through the portions 17*b* into the portion 17.

Figure 11:
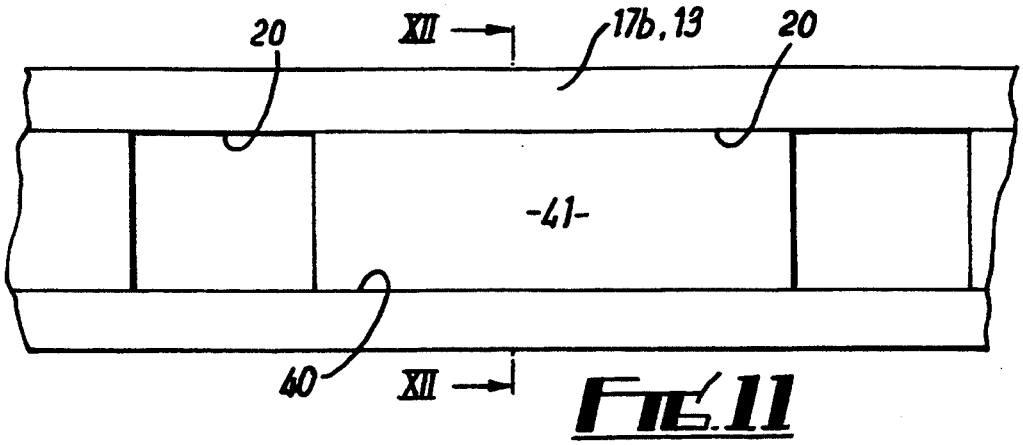
FIG. 11 is a view of a face of a rail directed towards the baluster.
Figure 12:
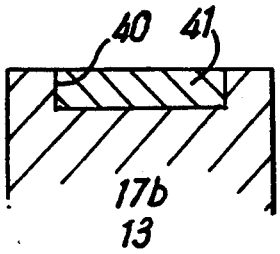
FIG. 12 is a cross-sectional view on the line XII—XII of FIG. 11.

FIGS. 11 and 12 illustrate how the faces of the portion 17*b* or the bottom rail 13 which are on the baluster side can be constructed. As will be appreciated, a rectangular socket 20 is required for each baluster. Whilst it is possible to create rectangular socket using woodworking machinery, it is not particularly easy. For this purpose, it can be more convenient to machine a continuous channel 40 in the surface of the rail 13 or portion 17*b* and then place individual spacing blocks 41 within the channel at appropriate intervals, the blocks being secured by adhesive and/or fasteners.

Referring now to FIGS. 7 to 10 there is now described a second preferred embodiment of pivot arrangement of a baluster of the invention. When using this arrangement the ends of the balusters are shaped to have surfaces 21 and 22 exactly as in the earlier embodiment. However, because of the nature of the hinge device used here, the hand rail 17 does not have to be in two parts. For this reason, a view comparable to FIG. 6 has not been provided.

In this second embodiment the hinge assembly 42 has a first part 43 and a second part 44. The parts 43 and 44 are identical and each consists of a pair of pillars. All four pillars are identical and each consists of a saw tooth plug 45, 46 respectively and a dome-shaped head 47 and 48 respectively. The heads 47 are connected by a pivot pin 49 (FIG. 9) and the heads 48 are connected by a pivot pin 50. In a manner exactly comparable to the insertion of the plugs 26, the plugs 45 and 46 are an interference press fit in slightly undersized apertures in the material of the rails and balusters. It is to be understood that the material of the balusters and rails will normally be wood, although the invention can be applicable to composite materials such as wood and/or plastics and/or other materials having similar strength, properties and hardness.

The two pins 49 , 50 are, in use, interconnected by a bridge in the form of a strip of spring steel which, at each end, is formed with a re-entrant hook 52,53. Each re-entrant hook is adapted to be a snap fit on a respective one of the pins 49,50. In use, the part 44 is pressed into the rail 17/18, and the part 43 is pressed into the end of the baluster 16. Thereafter, the bridge 51 is hooked over one of the pins 50 and then the other component of the pivot arrangement is moved so that its pin engages the respective other hook. The spring hook arrangement overcomes any problem of inserting the push-fit plugs 45,46 in the constricted spaces available.

In the second embodiment the relative pivoting between the rails and balusters is the same as in the first embodiment.

Referring now to FIGS. 13 to 17 , a further preferred balustrade 54 of the invention (FIG. 13) includes a pair of rails, of which only the hand rail is illustrated at 55, and a plurality of ballusters 56 extending between the two rails. Each end of each balluster 56 is connected to its respective rail by a pivot assembly and the pivot assembly will be described in relation only to one connection, namely that between baluster 56 and hand rail 55, it being understood that the other connections are comparable.

Figure 13:
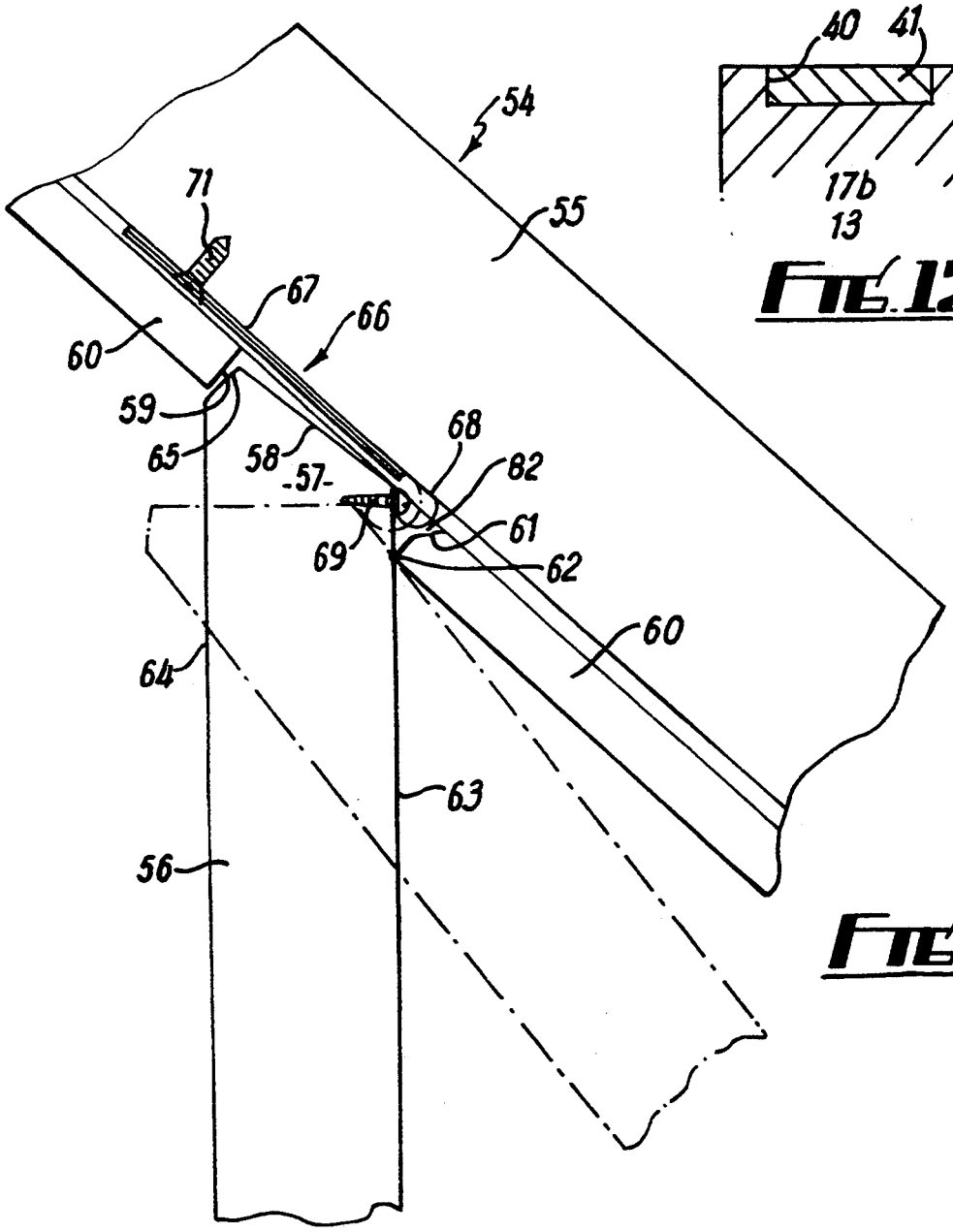
FIG. 13 is a side elevation illustrating a further form of connection between a balluster and the rail in a balustrade.

In FIG. 13 the balluster 56 shown as part of a sloping balustrade. Its upper end 57 is provided with an angled end face 58. The hand rail 55 is provided with a plurality of generally rectangular recesses 59 which are formed in a groove which extends longitudinally of the inner face of the hand rail and which is divided up by spacers 60. The upper end of each spacer 60 is chamfered on its interior edge at 61 to create a generally triangular recess 82. The outer edge of the spacer 60 at the upper end thereof provides a fulcrum, at point 62, which engages with the face 63 of the baluster 56. The opposite face 64 and the surface 58 terminate at and are joined by a transition surface 65 which is cylindrical about point 62.

To allow the end 57 of the balluster to pivot relative to the rail 55 and also to effect translational motion relative thereto into and out of the recess 59, a spring pivot device 66 is provided. Spring pivot device 66 is generally J-shaped in side view, and has an elongate body 67 and a curved head 68. The free end of head 68 is secured at 69 to the upper end of face 63. To constrain movement of the body 67 of spring pivot device 66 an inflexible plate 70 sandwiches the body 67 against the base of a channel 59*a* in the base of the recess 59. A common fastener 71 secures plate 70 and spring pivot device 66.

In use, the baluster 56 can pivot between the position shown in full in FIG. 13 and the position shown in dotted lines therein, for storage and transportation.

In use, the spring (to be described in detail later) allows movement of the baluster ends relative to the recesses 59 such as to allow variation in the balustrade angle from perhaps 38° to 42°, ample to accommodate facture and other tolerances. Of course, in different applications different angles can be chosen.

Figure 14:
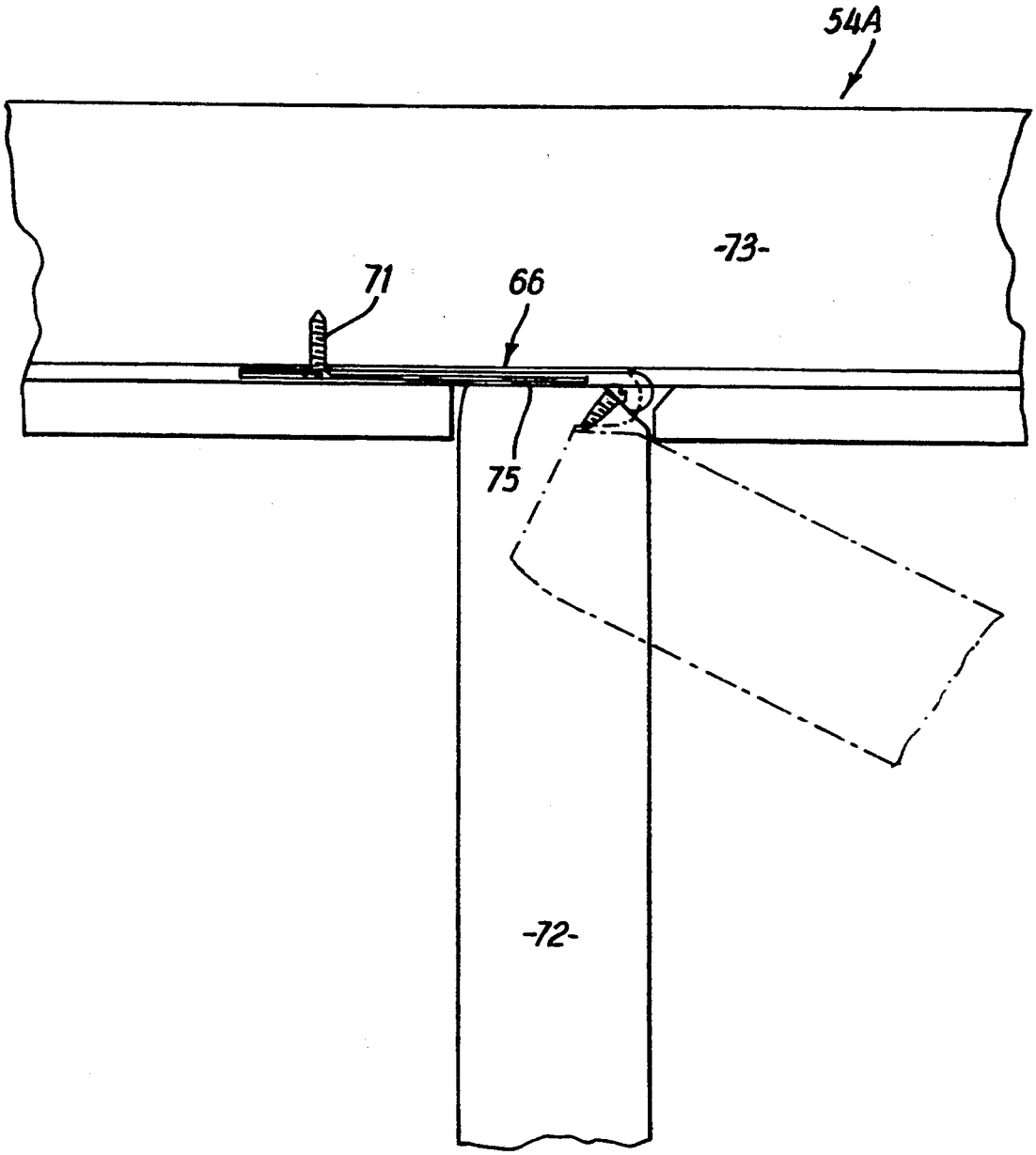
FIG. 14 is a comparable view illustrating a landing ballustrade.

FIG. 14 illustrates a slight variation wherein a foldable balustrade is to be provided for a landing or the like. Here, the balusters 72 have to be at right angles to the rail 73 and although the spacers 74 and the pivot arrangement including the spring 56 are the same, the upper face 75 of the baluster extends at right angles to the longitudinal axis of the baluster. In other respects the operation and function of the embodiment shown in FIG. 14 is analogous to that illustrated in FIG. 13.

FIGS. 15, 16 and 17 show the pivot arrangement, including the spring pivot device 66 in more detail.

The dimensions shown in FIG. 16 are in millimeters and illustrate a typical spring suitable for use with a domestic balustrade rising perhaps some 9 feet and having balusters approximately 35 mm square or comparable size. The spring is approximately 0.5 mm in thickness and is made from CS70 spring steel. This is adequate to allow the head 68 to wind and unwind to allow relative movement between the balusters and rails whilst maintaining a firm interconnection between them. It will be seen that at the end of the head 68 the spring is provided with a pair of outwardly extending lugs which have apertures 76 whereby the spring can be secured to the balustrade. Of course, other fastener means are possible.

In particular, instead of the screws shown at 69 and 71, push-in fitments engageable by friction and/or adhesive within sockets bored into the material of the balusters can be advantageous and lead to easier assembly. The spacers will normally be applied after the springs have been attached to the rails.

The embodiments herein described overcome the problem of providing a decorative, aesthetically pleasing balustrade wherein the ends of the balusters are housed within the rails, and where no open catchments are provided for dust or the like. The balustrade has all the appearance of a conventional rigid balustrade but has the advantages of minor adjustability for installation under varying conditions of the surroundings and also almost total folding for ease of storage, packaging and transportation.

The invention is not limited to the precise details of the foregoing and variations can be made thereto within the scope of the invention.

I claim:

1. A balustrade including a hand rail and a base rail interconnected by a plurality of parallel balusters, one end of each baluster being pivotally attached to the hand rail by a pivot arrangement, the other end of each baluster being pivotally attached to the base rail by a pivot arrangement, each of said pivot arrangements including a socket in the respective rail thereof adapted closely to surround and receive an end portion of the baluster and a hinge means connecting the baluster end portion to the respective rail thereof and constructed and arranged to allow relative pivotal movement therebetween about an axis extending transversely of the respective rail and baluster thereof and translational motion of same end portion of the baluster into and out of said socket.

2. A balustrade as claimed in claim 1, wherein the hinge means comprises a first part securable to the respective rail thereof and a second part securable to the baluster, the first and second parts being pivotally connected together, one of said first and second parts having two members, a first one of said two members being connected to the respective rail or baluster to which the part having two members is connected and a second one of said two members being telescopically connected to the other of said first and second parts and being telescopically movable relative to the first said member, to provide for translational motion between said rail and baluster.

3. A balustrade as claimed in claim 2, wherein said first and second parts are telescopically movable and spring loaded in a manner tending to draw the rail and balusters together.

4. A balustrade as claimed in claim 2 wherein that part having said two members is connected to the rail.

5. A balustrade as claimed in claim 4, wherein the rail comprises two rail elements, the hinge means having two members which are mounted in a first one of the rail elements and second one of the rail elements overlying the hinge means in the first rail element.

6. A balustrade as claimed in claim 1, wherein the hinge means comprises a first part securable to the rail and a second part securable to the baluster, there being a bridge connecting the first and second parts, the said bridge being pivotally connected to each of said first and second parts and maintaining said parts in spaced apart disposition.

7. A balustrade as claimed in claim 6, wherein the bridge is resiliently deformable.

8. A balustrade as claimed in claim 7, wherein the first and second parts each comprise a pair of headed pegs, the pegs of each pair being connected by a respective pin, the bridge comprising a strip of spring steel having a hook at each end and thus being generally of elongate S-shape, the hooks being a snap fit on the pins.

9. A balustrade as claimed in claim 1, wherein the hinge means comprises a spring which is secured to the rail and to the end of the baluster, the spring being J-shaped, a longer body of the spring being secured to the rail and the curve of the spring having an end secured to the baluster.

10. A balustrade as claimed in claim 9, wherein an inflexible plate overlies the said longer body of the spring to constrain movement thereof.

11. A balustrade as claimed in claim 1, wherein the end of the baluster is a close fit in its respective socket and the end of the baluster is arcuately chamfered at that edge thereof remote from the axis of pivotal motion between the baluster and rail.

12. A balustrade as claimed in claim 1, wherein the end face of the baluster is inclined to accord approximately to the angle between the baluster and rail in the erected condition of the balustrade.

13. A balustrade as claimed in claim 1, wherein the sockets and the ends of the balusters are of rectangular form.

* * * * *